United States Patent [19]

Simo et al.

[11] 4,220,522

[45] Sep. 2, 1980

[54] METHOD OF PROCESSING SOLIDS-CONTAINING OILS OR TARS

[75] Inventors: Thomas Simo, Bad Homburg; Karl H. Eisenlohr, Buchschlag, both of Fed. Rep. of Germany

[73] Assignee: Metallgesellschaft Aktiengesellschaft, Frankfurt am Main, Fed. Rep. of Germany

[21] Appl. No.: 9,972

[22] Filed: Feb. 6, 1979

[30] Foreign Application Priority Data

Feb. 17, 1978 [DE] Fed. Rep. of Germany ..... 2806806

[51] Int. Cl.[2] ..... C10G 1/00; C10G 1/02; C10B 53/06

[52] U.S. Cl. ..... 208/177; 208/8 R; 208/11 R

[58] Field of Search ..... 208/210, 89, 8 R, 8 LE, 208/177, 11 R

[56] References Cited

U.S. PATENT DOCUMENTS

| | | | |
|---|---|---|---|
| 3,932,266 | 1/1976 | Sze et al. | 208/8 LE |
| 3,944,480 | 3/1976 | Schroeder | 208/8 R |
| 3,947,346 | 3/1976 | Snell et al. | 208/8 LE |
| 4,036,731 | 7/1977 | Martin | 208/8 LE |
| 4,166,786 | 9/1979 | Duraiswamy et al. | 208/11 R |

*Primary Examiner*—George Crasanakis

*Attorney, Agent, or Firm*—Sprung, Felfe, Horn, Lynch & Kramer

[57] ABSTRACT

A process for refining a shale oil or tar fraction boiling below 200° C. is described wherein the shale oil or tar fraction is hydrogenated in the presence of a pre-hydrogenated naphtha which functions as a hydrogen transfer agent. Also described is a method for the production of such pre-hydrogenated naphtha from a solid containing shale oil or tar fraction boiling above 200° C.

18 Claims, 2 Drawing Figures

METHOD OF PROCESSING SOLIDS-CONTAINING OILS OR TARS

This invention relates to a method of processing solids-containing shale oils and tars which have been obtained by a dry distillation of oil shale or by the gasification of coal or by the pyrolysis and extraction of tar sand, which method comprises hydrogenating, separating the solids, and a further processing by hydrogenation and distillation to produce motor fuels.

It is known to remove combined or elementary arsenic from liquids which have been formed by the gasification of solid coal or by the distillation of oil shale or coal. For the purpose, solids such as oxides or sulfides of iron or of cobalt or of nickel are admixed, the mixture is treated with hydrogen at elevated temperature and elevated pressure, the arsenic is precipitated on the admixed solids, and finally the composite solids are removed (U.S. Pat. No. 3,933,624).

That known method has the disadvantage that a shale oil or tar which has thus been pretreated must be freed from the asphaltenes contained therein in an additional hydrogenating step or by other measures, such as deasphaltization or vacuum distillation, before hydrogenalysis can be effected.

In a succeeding hydrogenating sequence effected to produce motor fuels, the next step would thus be carried out to remove additional components, which decrease and/or inhibit the effectiveness of the hydrogenation catalysts, and also to break down or to remove asphaltenes. The same asphaltenes and other heteroatom-containing polar compounds contained in shale oil or tar inhibit also the preceding separation of the solids from the liquid phase because the solids are covered by films which consist mainly of the above-mentioned polar compounds and said solids can be removed only by expensive washing processes and repeated solid-liquid separating steps. For this reason the oil or tar to be subjected to further processing can be recovered with minimum loss only if steps are taken which oppose the wetting of the solids by the above-mentioned polar compounds.

It is an object of the invention to avoid these and other disadvantages of the state of the art and to provide a process which enables a simple removal of arsenic and/or antimony from substantially organic liquids, such as shale oil or tar, which are formed by the distillation of oil shale or coal or by the gasification of coal or by the pyrolysis or extraction of tar sand, and which also enables a considerable breakdown of asphaltenes and an at least partial removal of further heteroatoms and the recovery of a product which can subsequently be processed for hydrogenation. In that processing, the solids should be removed in a simple manner and additional hydrogenating and distilling steps should be conducted to produce motor fuel in a good yield.

This object is accomplished according to the invention in that a shale oil or tar feedstock is hydrogenated in the liquid (sump) phase at superatmospheric pressure and elevated temperature by a treatment with hydrogen in the presence of solids which consist substantially of coal, coke, and inorganic components originating from coal or oil shale respectively, and in the presence of naphthene-containing hydrogenated oil used as a hydrogen-transferring medium or of catalytically active solids which have been added to the feedstock, As, Sb and other elements contained in traces in the liquid phase are removed therefrom by said hydrogenation, asphalt and the heteroatoms, such as polar compounds which contain O, N and S, are decomposed at the same time to decrease the polarity of the liquid product, and the liquid product is subsequently separated from the solids.

A further feature of the invention is that the product which has been hydrogenated in the liquid (sump) phase and which has been freed from solids is distilled and then separated into prehydrogenated naphtha, oil and residue fractions.

According to a preferred further feature of the invention, the prehydrogenated distillates are subjected to further hydrogenating treatments.

According to a further feature of the invention, the hydrogenated naphtha fraction is subsequently reformed and/or isomerized.

It has been found that the hydrogenation in the liquid (sump) phase can be effected in the presence of supplementary catalytically active solids amounting to 1 to 10%, preferably 2 to 5%, by weight of the feedstock.

It has been also found that the hydrogenation in the liquid (sump) phase can desirably be effected in the presence of naphthene-containing hydrogenated oil in amounts of 0.5 to 2 parts by weight per part of the feedstock.

The hydrogenation in the liquid (sump) phase is suitably effected at temperature of 360° to 460° C., preferably 400° to 440° C., and at total pressures of 80 to 200 bars, preferably 100 and 150 bars.

The residence time of the feedstock in the liquid (sump) phase hydrogenation is desirably 0.5 to 2 hours, preferably 1 to 1.5hours.

According to a preferred further feature of the invention, the solids are separated from a substantially asphalt-free medium.

According to a preferred further feature of the invention the first distillation is effected under normal pressure, prehydrogenated naphtha is withdrawn as an overhead product, and the residue is supplied to one or more hydrogenating stages.

Alternatively, the residue from the first distillation may be repeatedly distilled at subatmospheric pressure, whereafter the residue is withdrawn and the vacuum distillate is supplied to one or more succeeding hydrogenating stages.

In that case the residue of such a distillation contains the remaining asphaltenes, which have not been broken down and represent the feed for hydrogen production coking or the like.

According to a preferred further feature of the invention, part of the hydrogenated product is withdrawn from the second distillation stage and recycled to the second hydrogenating stage.

In accordance with a preferred further feature of the invention the product leaving the fixed-bed hydrogenation stage or hydrogenation stages is separated in the second distillation stage into naphtha, diesel fuel, and residue.

To special advantage, the residue from the second vacuum distillation stage is recycled and used as the naphthene-containing oil in the hydrogenation in the liquid (sump) phase.

Also within the scope of the invention, part of the residue from the second atmospheric distillation stage can be recycled and used as naphthene-containing oil in the hydrogenation in the liquid (sump) phase additionally.

The advantages afforded by the invention reside essentially in that the polar constituents of the liquid, such as asphaltenes and compounds containing heteroatoms in general, which have been found to wet the shale oil or tar solids consisting substantially of coke, coal and/or inorganic components, can be hydrogenalyzed to expose said solids. In one and the same step, the trace elements can be removed and the asphaltenes can be broken down and heteroatoms be removed in the presence of the solids. The solid-liquid separation can be improved at the same time.

The hydrogenation may be effected in the presence of a naphthene-containing hydrogentated oil, which is recirculated and used as a hydrogen-transferring medium, or in the presence of an entrained, fine-grained additional solid which is catalytically active. That catalyst is suitably discarded after a single use and may consist, e.g., of iron-oxide containing by-products which are moderately active and become available as alumina is concentrated.

The invention provides a simple, straightforward process of producing motor fuel in a high yield.

BRIEF DESCRIPTION OF DRAWINGS

The invention will now be described more fully with reference to the drawings, in which.

DESCRIPTION OF SPECIFIC EMBODIMENTS

Figure 1:
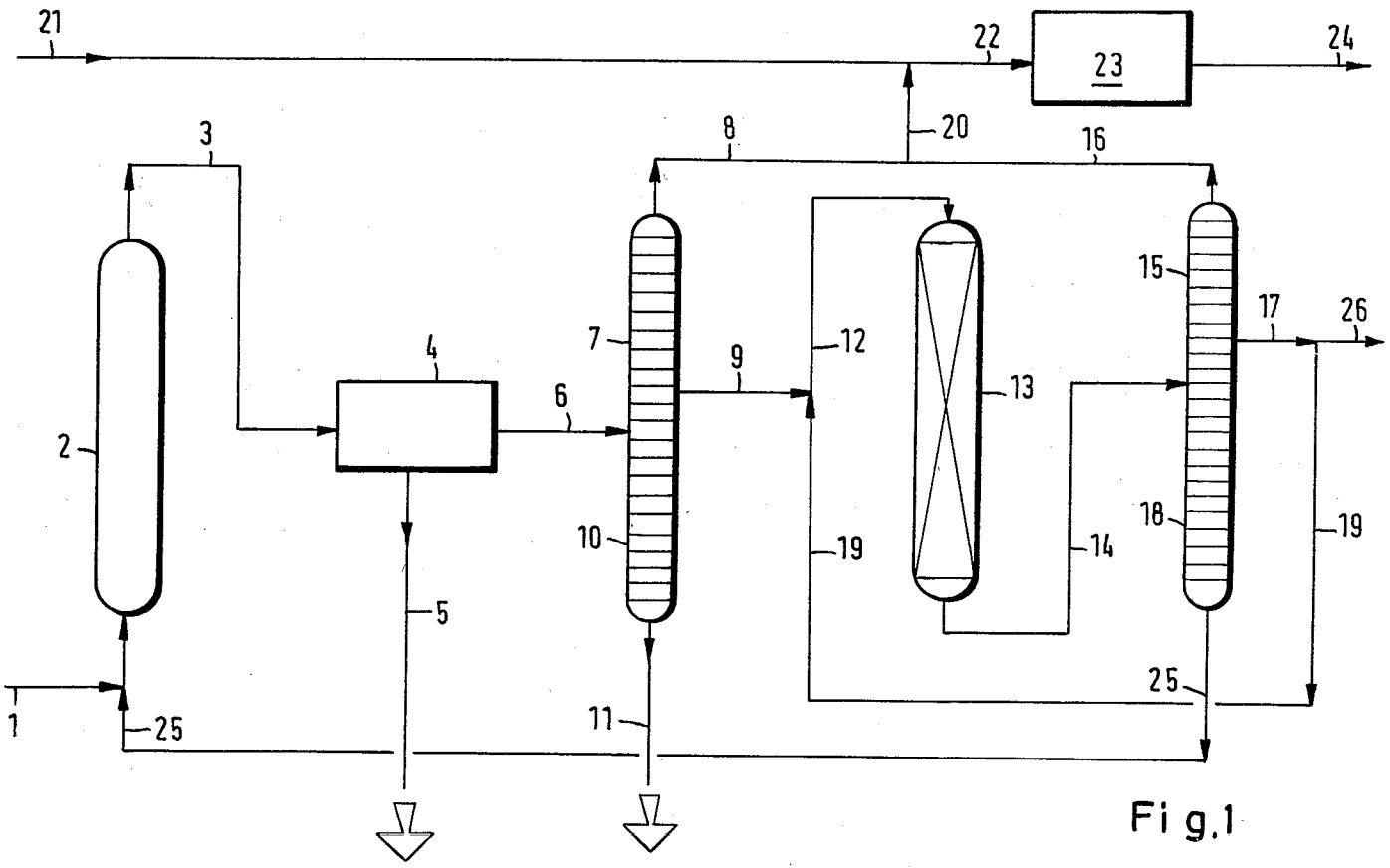
FIG. 1 is a diagrammatic representation showing by way of example the liquid and solid streams—omitting all gas streams, gas-liquid separations, gas recycle and corresponding utilities—used in the method according to the invention where naphthene-containing hydrogenated oil is employed as a hydrogen-transferring medium.
Figure 2:
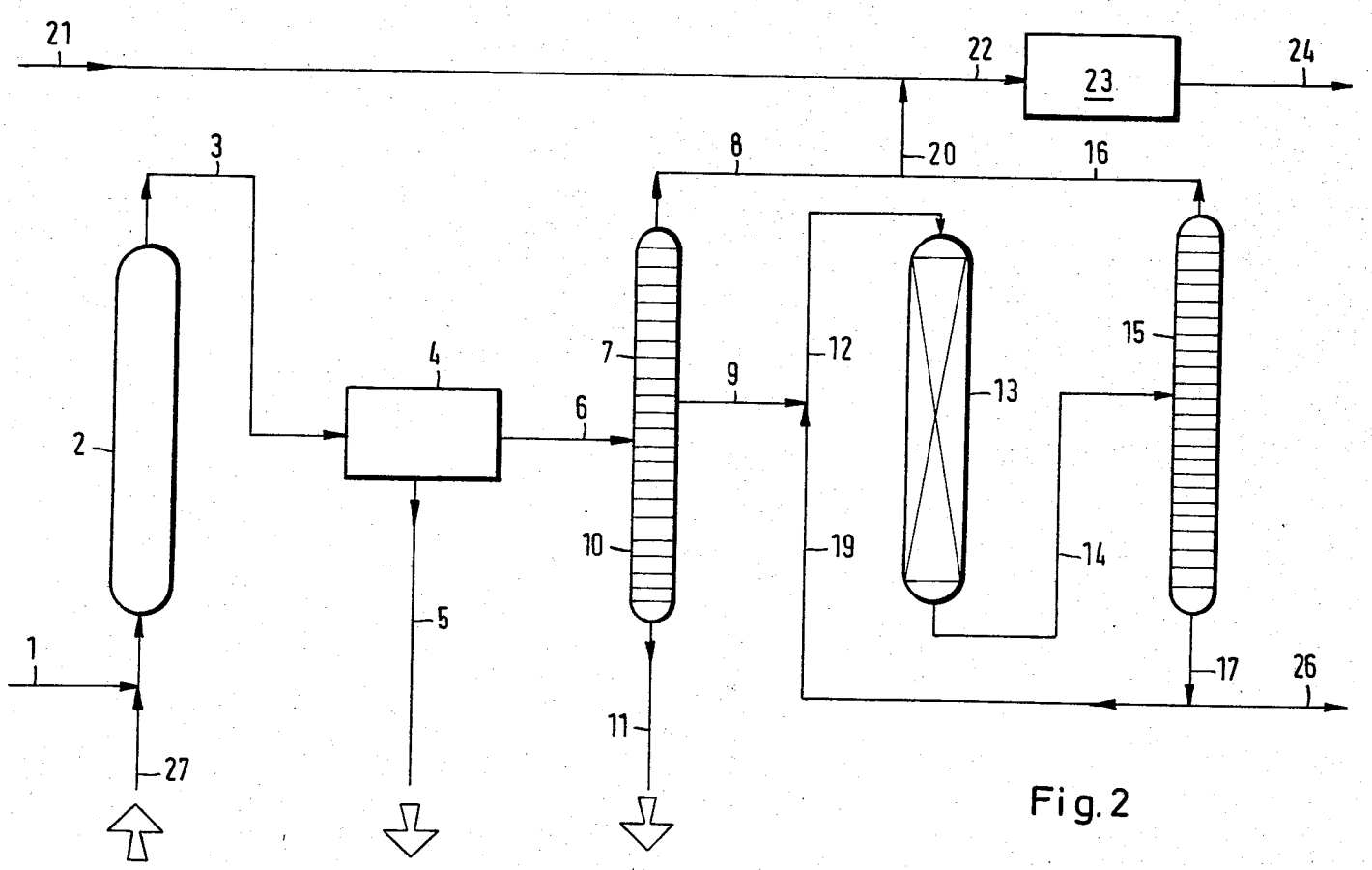
FIG. 2 shows the same process as FIG. 1 as applied to a feedstock to which dried red mud has been added as a catalyst.

The reference characters in the drawings have the following meanings: 1—feedstock: solids-containing shale oil or tar fractions boiling above 200° C.; 2—liquid (sump) phase hydrogenation stage; 3—product of liquid (sump) phase hydrogenation; 4—stage for separation of solids from liquid product; 5—solids; 6—solids-free liquid product of liquid (sump) phase hydrogenation; 7—atmospheric distillation stage; 8—naphtha cut from liquid (sump) phase hydrogenation; 9—residue from atmospheric distillation or vacuum distillate from the topped-off liquid (sump) phase hydrogenation product; 10—vacuum distillation; 11—vacuum distillation residue; 12—feed stream to second hydrogenation stage; 13—second hydrogenation stage: fixed-bed hydrogenation in one stage or several sub-stages; 14—product stream from second hydrogenation stage; 15—atmospheric distillation stage; 16—naphtha cut from second hydrogenation; 17—residue from atmospheric distillation stage 15 or vacuum distillate; 18—vacuum distillation stage; 19—stream recycled to the second hydrogenation stage; 20—combined prehydrogenated naphtha streams; 21—feedstock: shale oil or tar fractions boiling below 200° C. (raw naphtha); 22—feed to naphtha hydrogenation stage; 23—stage for hydrogenation of naphtha and further processing to produce motor gasoline; 24—motor gasoline; 25—residue from vacuum distillation stage 18; 26—diesel fuel product; 27—catalyst.

EXAMPLE 1 (FIG. 1)

The entire shale oil or tar is separated by a topping distillation at 200° C. The resulting feedstock streams are designated 1 and 21 in FIG. 1. Fraction 1 which boils above 200° C. and contains solids is mixed with naphthene- containing hydrogenated oil 25 and is hydrogenated in a liquid (sump) phase hydrogenation stage 2. The product 3 is centrifuged and/or filtered in stage 4 to remove solids 5. The liquid stream 6 is distilled under atmospheric pressure in stage 7. The overhead product of that distillation consists of prehydrogenated naphtha 8. If the asphaltenes have been completely broken down, the residue of that distillation can be supplied in conduit 9 to the succeeding hydrogenation stage. If the stream 6 is not free from asphalt, the residue from the distillation stage 7 is re-distilled under a vacuum in stage 10. The vacuum distillate 9 is then supplied to the succeeding hydrogenation stage and a vacuum distillation residue 11 is withdrawn.

The hydrogenation carried out in one stage or in several sub-stages in the fixed-bed hydrogenation stage 13 results in a hydrogenation and refining of the asphalt-free stream 9. Hydrogenated oil 19 boiling in the diesel fuel range is suitably circulated. The feed stream 12 which has been blended with recycled oil is supplied to the hydrogenation unit 13. The product stream 14 leaving stage 13 is substantially free from heteroatoms and as a result of the hydrogenolysis contains a newly formed low boiling fraction. The final boiling point has also been lowered. The naphtha is separated in the atmospheric distillation stage 15 and as stream 16 added to the feed for the naphtha hydrogenation stage 23. The residue from the atmospheric distillation stage 15 is separated in the vacuum distillation stage 18 into a diesel fuel distillate 17 boiling between 200° and 380° C. and a residue 25 boiling above 380° C. The latter is recycled to the liquid (sump) phase hydrogenation stage 2. Part of the vacuum distillate 17 constitutes the stream 19 which is recirculated to the fixed-bed hydrogenation stage 13. The remaining stage 26 is the diesel fuel product of the process.

The prehydrogenated naphtha streams are combined in stream 20, which together with the feedstock stream 21 consisting of shale oil or tar fractions boiling below 200° C. is supplied as stream 22 to the naphtha hydrogenation, reforming and stabilizing stages 23, in which motor gasoline 24 is produced.

If the hydrogenation stage 13 is operated so that the stream 14 contains insufficient or no fractions boiling above 350° C., the stream 25 should be supplemented from stream 26. In an extreme case the vacuum distillation in 18 can be omitted and the stream 17 consisting in this case of the entire residue from distillation stage 16 can be divided among streams 19, 25 and 26.

If the feedstock 1 contains 2.5% weight asphalt and the feedstock streams 1 and 25 have a weight ratio of 1:1.5 and stream 25 contains at least 18% naphthenes, the asphalt content in stream 3 or 6 will be less than 0.005%. Stream 11 is not discarded in that case.

The yield of hydrogenated products boiling below 200° C. is 60%. The yeild of diesel fuel (stream 26) is 40%. Stream 6 is free from asphalt.

EXAMPLE 2 (FIG. 2)

The process is carried out as in Example 1 with the difference that there is no recycling of oil (stream 25 in FIG. 1) but 3% by weight red mud (stream 27) is added to the solids-containing feedstock oil. 75% of the asphalt are broken down and the residue 11 amounts to 5% of the feedstock. The "one way" catalyst and the solids are jointly separated in the solid-liquid separating stage 4 to form stage 5. Streams 14 and 17 have a final boiling point of 380° C.

In this case, the yield of fractions boiling below 200° C. is 50% and the yield of diesel fuel 45%.

What is claimed is:

1. In a method of processing an oil or tar obtained by a dry distillation of oil shale or coal or by the gasification of coal or by the pyrolysis or extraction of tar sand, which oil or tar contains finely dispersed solid material therein wherein the oil or tar is hydrogenated, the hydrogenation product is treated to remove solids and the resultant hydrogenation product free of solids is further processed to a final product, the improvement wherein the hydrogenation of the oil or tar in the presence of said solids is effected in the presence of a naphthene-containing hydrogenated oil.

2. A process according to claim 1 wherein said hydrogenation is effected in the liquid phase and the resultant product, following removal of said solids, is distilled into a pre-hydrogenated naphtha, oil and residual fractions.

3. A process according to claim 2 wherein the pre-hydrogenate distillate is subjected to a further hydrogenation.

4. A process according to claim 2 wherein the hydrogenated product, following removal of said solids, is distilled to remove a naphtha fraction and said naphtha fraction is thereafter reformed or isomerized.

5. A process according to claim 1 wherein said hydrogenation is effected in the presence of a catalytically active solid which is present in an amount of 1 to 10% by weight based upon the weight of said oil or tar.

6. A process according to claim 5 wherein said catalytically active solid is present in an amount of between 2 and 5% by weight.

7. A process according to claim 1 wherein said naphthene-containing hydrogenated oil is present in an amount of 0.5 and 2 parts by weight per part of oil or tar.

8. A process according to claim 1 wherein said hydrogenation is effected at a temperature of 360° to 460° C. at a total pressure of 80 to 200 bars.

9. A process according to claim 8 wherein said hydrogenation is effected at a temperature of 400° to 440° C.

10. A process according to claim 8 wherein said hydrogenation is effected at a total pressure of 100 to 150 bars.

11. A process according to claim 8 wherein the residence time of said oil or tar during said hydrogenation is 0.5 to 2 hours.

12. A process according to claim 11 wherein said residence time is 1 to 1.5 hours.

13. A process according to claim 1 wherein, following removal of said solids, the hydrogenated product is distilled at normal pressure, a pre-hydrogenated naphtha is withdrawn as overhead product and a residue is removed, and said residue is introduced to at least on subsequent hydrogenation stage.

14. A process according to claim 13 wherein said residue from said distillation is thereafter distilled at sub- atmospheric pressure, a vacuum residue is withdrawn and the vacuum distillate is introduced into at least one subsequent hydrogenation process.

15. A process according to claim 13 wherein product from a subsequent hydrogenation process is distilled in a subsequent distillation and hydrogenated naphtha is obtained as overhead and a naphthene-containing hydrogenated oil is obtained as residue which residue is recycled to the first-mentioned hydrogenation.

16. A process according to claim 5 wherein said hydrogenation is effective as a fixed bed hydrogenation.

17. A process according to claim 1 wherein said naphthene-containing hydrogenated oil is supplied by distilling the hydrogenation product from the hydrogenation following removal of solids and recycling a naphthene- containing hydrogenated oil from said distillation to the hydrogenation zone.

18. A process according to claim 6 wherein said catalytically active solid comprises an iron oxide.

* * * * *

UNITED STATES PATENT AND TRADEMARK OFFICE

CERTIFICATE OF CORRECTION

PATENT NO. : 4220522

DATED : Sept. 2, 1980

INVENTOR(S) : THOMAS SIMO and KARL H. EISENLOHR

It is certified that error appears in the above—identified patent and that said Letters Patent is hereby corrected as shown below:

| COLUMN | LINE | |
|---|---|---|
| 2 | 31 | "and" should be --to--. |
| 4 | 51 | "350" should be --380-- |

Signed and Sealed this

*Twenty-fifth* Day of *November 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,220,522

DATED : September 2, 1980

INVENTOR(S) : THOMAS SIMO and KARL H. EISENLOHR

It is certified that error appears in the above—identified patent and that said Letters Patent is hereby corrected as shown below:

In line 2 of the Abstract "below" should be --above--.

In line 4 of the Abstract, "naphtha" should be --naphthene-containing hydrogenated oil fraction- In line 6 of the Abstract, "naphtha" should be --naphthene-containing hydrogenated oil fraction--.

Signed and Sealed this

*Eighth* Day of *September 1981*

[SEAL]

*Attest:*

GERALD J. MOSSINGHOFF

*Attesting Officer*

*Commissioner of Patents and Trademarks*